United States Patent [19]

Schubert

[11] Patent Number: 4,886,437

[45] **Date of Patent: * Dec. 12, 1989**

[54] BEARING ARRANGEMENT OF AN EXTERNAL-AXIAL ROTARY PISTON BLOWER

[75] Inventor: Werner Schubert, Lindau, Fed. Rep. of Germany

[73] Assignee: Wankel GmbH, Berlin, Fed. Rep. of Germany

[ * ] Notice: The portion of the term of this patent subsequent to Jan. 10, 2006 has been disclaimed.

[21] Appl. No.: 263,684

[22] Filed: Oct. 28, 1988

Related U.S. Application Data

[63] Continuation of Ser. No. 58,922, Jun. 5, 1987, Pat. No. 4,797,078.

[30] Foreign Application Priority Data

Jun. 11, 1986 [DE] Fed. Rep. of Germany ..... 3619645

[51] Int. Cl.[4] ..... F04C 10/18

[52] U.S. Cl. ..... 418/206; 384/482

[58] Field of Search ..... 418/206; 384/482

[56] References Cited

U.S. PATENT DOCUMENTS

| | | | |
|---|---|---|---|
| 2,684,631 | 7/1954 | Anthony | 418/206 |
| 2,939,548 | 6/1960 | Mc Vicar | 418/206 |
| 3,106,166 | 10/1963 | Tomasko | 418/206 |
| 3,275,225 | 9/1966 | Schultz | 418/206 |
| 3,586,404 | 6/1971 | Zahn | 384/482 |
| 3,669,577 | 6/1972 | Swanson | 418/206 |
| 3,951,783 | 4/1976 | Cochran | 384/482 |
| 4,040,683 | 8/1977 | Korenhof | 384/482 |
| 4,505,484 | 3/1985 | Ohkuma | 384/482 |
| 4,813,857 | 3/1989 | Kawarami | 418/206 |

FOREIGN PATENT DOCUMENTS

| | | | |
|---|---|---|---|
| 3436205 | 4/1986 | Fed. Rep. of Germany | 418/206 |
| 2118628 | 11/1983 | United Kingdom | 418/206 |

*Primary Examiner*—William L. Freeh

*Attorney, Agent, or Firm*—Becker & Becker, Inc.

[57] ABSTRACT

A bearing arrangement of an external axial rotary piston blower for gaseous medium having a housing which consists of an interior runaway surface and two side parts through which shafts project upon which pistons rotating therewith form working chambers. The shafts of these pistons have ball bearings with lip flap or face seals for sealing-off of gas pressure in the working chambers as well as externally of these bearings having transmission gears journalled with respect to the side parts. Bearing necks or collars are formed and provided with the ball bearings for the shafts of the pistons and these annular grooves are open extending radially outwardly. Groove walls on the transmission side along with inner edges of the gear rings of the gears of the transmission form an annular gap of closest narrow tolerance. A further annular gap can be provided between the bores for the shafts and the bearing necks and the hubs of the gears of the transmission. The annular gaps have a width in a range of a tenth to a twentieth of a millimeter of narrowest close tolerance. An annular chamber is arranged on a side of an end plate of shaft toward the side part. A passage communicates with gap chambers between one end plate of a shaft and an adjoining side part on the one hand. A check valve communicates via a bore in the side part on the other hand.

7 Claims, 1 Drawing Sheet

BEARING ARRANGEMENT OF AN EXTERNAL-AXIAL ROTARY PISTON BLOWER

This is a continuation of copending allowed parent application Ser. No. 058,922-Schubert filed June 5,1987, now U.S. Pat. No. 4,797,078-Schubert dated Jan. 10, 1989 and belonging to the assignee of the present invention.

BACKGROUND OF THE INVENTION

1. Field of the Invention

The present invention relates to a bearing arrangement of an external-axial rotary piston blower for gaseous media with a housing which consists of a casing with an internal raceway surface and two side parts and a piston rotating in the housing to form working or operating chambers therewith, whereby the shafts of these pistons have ball bearings with lip seals for sealing-off of the gas pressure in the working or operating chambers as well as having gear wheels externally of these bearings.

2. Description of the Prior Art

Such blowers can be those of so-called Rootstype of construction or half-roller i.e. semi-cylinder blower type of construction respectively quarter-roller i.e. quarter-cylinder-blower type of construction, which have two pistons identical among each other operating in meshing, complementary or dovetail engagement rotating oppositely with a transmission ratio 1:1. Such blowers are employed and utilized especially as chargers for internal combustion engines with air as a working or operating medium.

With such machines, which for economical and efficiency reasons must have a simple, straightforward construction as inexpensive as possible in mass production, the working chambers are sealed-off only by sealing gaps with respect to each other and relative to shaft passages through the side parts of the housing. The changing impingement, impacting or stress of the working chamber with over pressure and under pressure leads to a pulsation of the working medium that subjects the ball bearings to flow impact or shocks changing in rapid sequence as to the direction thereof. The lip flap or face seals of the particular respective ball bearing close during over pressure in the adjoining working chamber and in the gap spaces connecting with the ball bearings. There cannot be avoided however that an over pressure builds up via an incomplete sealing-off of the bearings in the cover space or chamber receiving the gear wheels, which over pressure opens the lip flap or face seals of the ball bearings after the suction cycle located in the working or operating chambers and thereby pressing the transmission lubricant into these working chambers. Consequently transmission lubricant is lost not only uncontrolled but rather transmission lubricant also reaches and comes into the operating medium which is to be free of oil.

The lip flap or face seals lift likewise during under pressure in the working or operating chambers respectively in the gap spaces or chambers connecting them with the ball bearings, whereby then in essence the bearing grease or lubricant is suctioned away from the permanently lubricated ball bearings so that these ball bearings very soon suffer damage.

In so doing there is to be noted that the suctioning-off of the transmission grease or lubricant occurs then when under pressure occurs or arises only upon the side of the bearing toward the working or operating chambers, while the lubricant or oil pressed through the ball bearings during over pressure in the cover chamber or space can prevent this suctioning-off. Accordingly, measures are not sufficient or adequate which prevent the occurrence of such an under pressure upon the working or operating chamber side of the ball bearings. On the other hand, also the arrangement of an over pressure valve at the cover space or chamber is not adequate or sufficient, since the lubricant or oil creeping, leaking or flowing in the ball bearings already is pressed through these ball bearings before the over pressure valve responds or reacts.

SUMMARY OF THE INVENTION

An object of the present invention is to avoid the effect of pressure pulsations of the working or operating medium effective or having an influence upon the ball bearings, especially to avoid the passage of the transmission lubricant or oil through the ball bearings as a consequence of over pressure in the transmission chamber as well as to avoid the suctioning-off of the ball bearing grease or lubricant by under pressure on the working or operating chamber side of the ball bearings.

This object is fulfilled and resolved by features in accordance with the present invention provided with the blower of the types mentioned previously herein.

BRIEF DESCRIPTION OF THE DRAWING

This object, and other objects and advantages of the present invention, will appear more clearly from the following specification in conjunction with the accompanying drawing.

DESCRIPTION OF PREFERRED EMBODIMENTS

Figure 1:
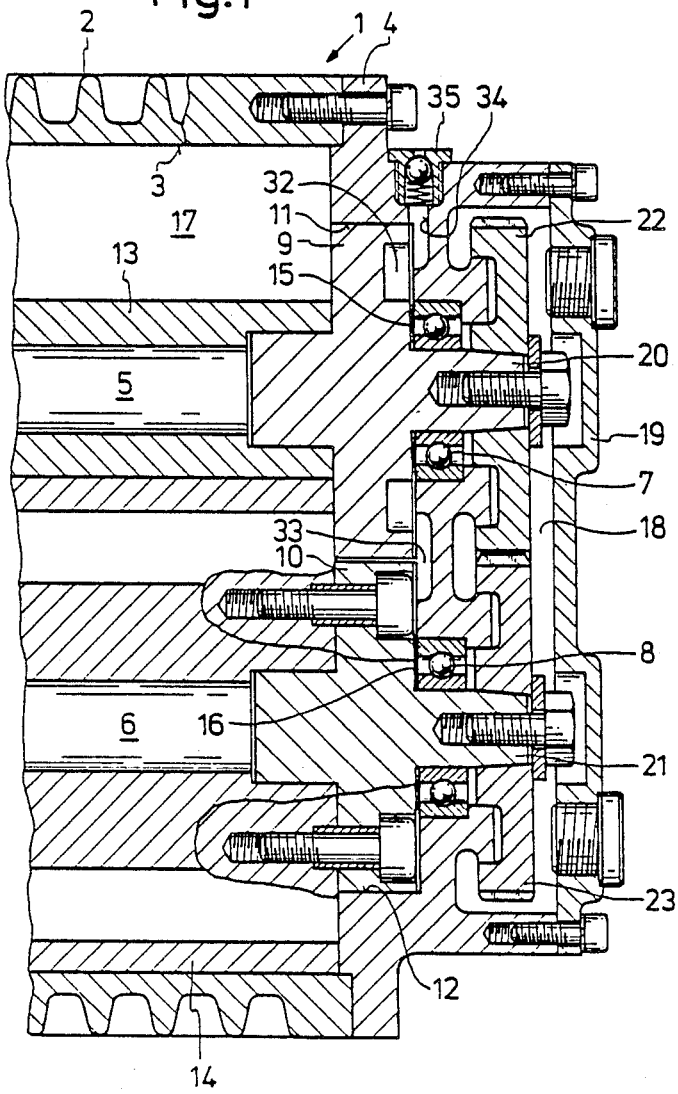
FIG. 1 is a view that shows an axial section through a transmission side of a quarter-cylinder blower.

Referring now to the drawing in detail, reference being made to FIG. 1, the housing 1 of the blower consists of a casing part 2 provided with cooling ribs externally thereof with an interior runway surface 3 which is formed of two cylinders intersecting each other in an inlet region and outlet region. The casing part 2 is closed-off laterally by two side parts or plates 4, of which only the one side plate 4 is shown that is located on the transmission side of the blower. The housing has two shafts 5 and 6 passing axially therethrough and these shafts run or turn in ball bearings 7 and 8 arranged in the side plates. The shafts on both sides have end plates 9 and 10, which rotate with smallest or most minimal gap in recesses or bores 11 and 12 in the side parts and with which the pistons 13 and 14 are secured in a union, screw coupling or connection. These pistons 13 and 14 among each other are identical and radially symmetrical. The piston 13 is cut in a plane of a short radial axis thereof and the piston 14 is cut in a plane of a long radial axis thereof. The ball bearings have bearing seals at 15 and 16 in the form of sealing lips, flap or faces which during over pressure in the working or operating chamber 17 close any leakage path via the ball bearings 7 and 8 relative to a chamber 18 in the housing lid or cover 19. Transmission gears or wheels 22 and 23 are wedged or pressed fitted with a 1:1 transmission ratio externally of the ball bearings and area located upon the shaft butts or ends 20 and 21 formed by the end plates 9 and 10. When an over-pressure condition exists in a space or chamber 18 in the housing cover or lid relative to the suction chamber, such over pressure being built up via pulsation shocks or impacts of the operating medium through the gap seals at the bores or recesses 11 and 12 and through the bearing seals 15 and 16, the oil or lubricant flowing or running around the transmission gears or wheels is pressed through the ball bearings and the lip flap or face ball bearing seals 15 and 16 thereof then opening into the aforementioned gap chambers or spaces and the working or operating chamber 17 respectively at the time being located in the suction stroke of a machine cycle.

Figure 2:
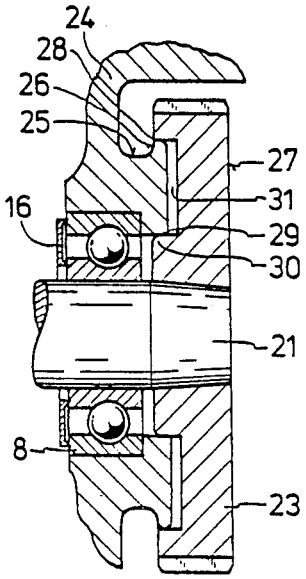
FIG. 2 is a view that shows an enlarged section of structure shown in FIG. 1.

In order to avoid this, as illustrated in FIG. 2 for the shaft butt or end 21 (which is true and applicable in the same manner for the shaft butt or end 20) in accordance with the present invention there is provided an annular groove 25 around a bearing neck or collar 24 of the shaft bearing 8 and this annular groove or recess 25 is open radially outwardly. Any oil or lubricant reaching or coming into the annular groove 25 drains downwardly around the bearing 8. The wall 26 of the annular groove 25 on the drive or transmission side is drawn upwardly or raised upwardly so far that this wall 26 together with an inner edge 27 of the ring gear or toothed wheel of the gear 23 forms a narrow annular gap 28, which hinders or prevents the passage of oil or lubricant in a direction onto the shaft 6. A second annular gap 29 like this is formed between a hub 30 of the gear 23 and a shaft bore of the bearing neck or collar 24, whereby an annular space or chamber 31 (FIG. 2) enclosed between these ring or annular gaps 28 and 29 serves as a buffer space or chamber for the pulsation shocks or impacts of the working or operating medium.

In order to hinder or prevent occurrence, origination or formation of an under-pressure condition in the gap chambers or spaces between the recesses or bores 11 and 12 and the side part 4 as well as the ball bearing seals 15 and 16, a ring or annular chamber 32 is provided as shown in FIG. 1 in the end plate 9 on a side thereof toward the side part 4; this annular space or chamber 32 is connected with a passage 33 cutout or cutaway in the side part 4 to communicate with the gap spaces or chambers between the side part 4 and the ball bearing 8 as well as between the side part 4 and the end plate 10. Furthermore, a bore 34 is provided at the highest point of the side part 4 and this bore 34 opens to the ring or annular chamber 32 in the end plate 9 and a check valve 35 is arranged in an outer end thereof, this check valve 35 then being capable of opening during under pressure in the ring or annular chamber 32 and the adjoining gap chambers or spaces. Under pressure occurring as encountered or arising on the inner side of the ball bearing is equalized, compensated and self-regulated with this check valve 35 and with that the suctioning of bearing grease or lubricant is prevented, while the annular gaps formed as tight or narrow spaces at the bearing neck or collar and the transmission gears or wheels prevent overflow or passage of lubricant or oil during over pressure into the cover or lid space or chamber 18, so far as this oil or lubricant is not already drained from the annular grooves 25.

The annular gap 28 between the groove wall 26 on the transmission drive side and the inner edge of the gear ring of the gears 22, 23 of the transmission as well as gap seals 29 between the bearing necks 24 and the hubs 30 of the gears 22, 23 of the transmission have a width in a range of a tenth to a twentieth millimeter.

The present invention is, of course, in no way restricted to the specific disclosure of the specification and drawing, but also encompasses any modifications within the scope of the appended claims.

What I claim is:

1. In a bearing arrangement of an axial rotary piston blower for gaseous medium with a closed housing having a sidewall means forming working chambers with two internal intermeshing rotary pistons rotating on parallel shafts and journalled in antifriction bearings mounted on a side of a transmission gear means in a bearing collar means, said housing further consisting of an interior runway surface and two side plates and forming the working chambers with said rotary pistons rotating therein, whereby said parallel shafts upon which said rotary pistons are mounted have shaft ends journaled by said antifriction bearings with face seals laterally outside and extending radially in a location axially immediately adjacent to one side thereof for sealing-off of gas pressure in the working chambers, said antifriction bearings also having bearing collar means adjoining said shaft ends for mounting of said bearings and said transmission gear means of said blower located externally of said bearings, said bearing collar means projecting outwardly from the sidewall means of said housing and forming outwardly radial grooves around shoulders thereof whereby an oil seal of said antifriction bearings between these antifriction bearings and the working chambers in said closed housing for each antifriction bearing is formed by two gap seals and an annular space for buffering pulsation impacts of said rotary piston blower and located between these gap seals having the improvement in combination therewith comprising:

annular groove means which are open in a direction extending radially outwardly around said bearing collar means of said antifriction bearings of said shafts of the rotary pistons; and radially located walls provided on the transmission gear means side of said annular groove means opposed to inner recess edges of the transmission gear means forming therewith an annular gap of closest narrow tolerance extending axially therebetween in a contactless manner and forming sealing gaps therewith.

2. In a bearing arrangement in combination according to claim 1, in which means forming axial bores for said shaft ends as well as axial hubs of said transmission gear means and further annular gaps are provided coaxially internally with respect to said axial bores for said shaft ends located in the bearing collar means axially relative to said axial hubs of said transmission gear means therewith.

3. In a bearing arrangement in combination according to claim 2, in which a width in a range of a tenth to a twentieth millimeter is provided for the annular gaps axially between the radially located wall on the transmission gear means side thereof and the inner recess edges of the transmission gear means respectively as well as for the further annular gaps axially between the bearing collar means and the axial hubs of the transmission gear means.

4. A bearing arrangement according to claim 3, comprising an annular chamber means formed and arranged extending radially on a side laterally of one end plate of one shaft on a side toward the side plate, said annular chamber means communicating via a centrally located passage with gap chambers between the other end plate of the shaft and the adjoining side plate.

5. A bearing arrangement of an axial rotary piston blower including transmission gear means therewith and provided for gaseous medium with a housing consisting of an interior runway surface and two side plates and forming working chambers with pistons rotating therein, whereby shafts upon which said pistons are mounted have shaft ends journaled by ball bearings with face seals laterally outside and extending radially in a location axially immediately adjacent to one side thereof for sealing-off of gas pressure in the working chambers, said bearings also having bearing collar means adjoining said shaft ends for mounting of said bearings and said transmission gear means of said blower located externally of said bearings, said arrangement comprising:

annular groove means which are open in a direction extending radially outwardly around said bearing collar means of ball bearings of said shafts of said pistons;

radially located walls provided on a transmission gear means side of said annular groove means opposed to inner recess edges of the transmission gear means forming therewith an annular gap of closest narrow tolerance extending axially therebetween;

means forming axial bores for said shaft ends as well as axial hubs of said transmission gear means and further annular gaps provided coaxially internally with respect to said axial bores for said shaft ends located in the bearing collar means axially relative to said axial hubs of said transmission gear means therewith;

a width in a range of a tenth to a twentieth millimeter being provided for the annular gaps axially between the radially located wall on the transmission gear means side thereof and the inner recess edges of the transmission gear means respectively as well as for the further annular gaps axially between the bearing collar means and the axial hubs of the transmission gear means; and an annular chamber means formed and arranged extending radially on a side laterally of one end plate of one shaft on a side toward the side plate, said annular chamber means communicating via a centrally located passage with gap chambers between the other end plate of the shaft and the adjoining side plate.

6. A bearing arrangement according to claim 5, in which further annular gaps are provided coaxially internally between axial bores for said shaft ends located in the bearing collar means axially relative to axial hubs of gears of the transmission drive therewith.

7. A bearing arrangement according to claim 6, in which a width in a range of a tenth to a twentieth millimeter is provided for the annular gaps axially between the radially located wall on the transmission drive side and the inner recess edges of the gear rings of the gears of the transmission respectively as well as for the further annular gaps axially between the bearing collar means and the axial hubs of the gears of the transmission.

* * * * *